US005715318A

United States Patent [19]

Hill et al.

[11] Patent Number: 5,715,318

[45] Date of Patent: Feb. 3, 1998

[54] AUDIO SIGNAL PROCESSING

[76] Inventors: Philip Nicholas Cuthbertson Hill, Faircross, Curridge Road, Newbury, Berkshire, United Kingdom, RG16 9DH; Christopher James Pickard, 40 Painswick Close, Witney, Oxfordshire, United Kingdom, OX6 5FX

[21] Appl. No.: 556,870

[22] Filed: Nov. 2, 1995

[30] Foreign Application Priority Data

Nov. 3, 1994 [GB] United Kingdom ..... 9422208

[51] Int. Cl.[6] ..... H04R 5/02

[52] U.S. Cl. ..... 381/24; 381/17

[58] Field of Search ..... 381/17, 24, 25; 463/32, 33, 35

[56] References Cited

U.S. PATENT DOCUMENTS

| | | | |
|---|---|---|---|
| 4,792,974 | 12/1988 | Chace . | |
| 4,868,687 | 9/1989 | Penn et al. . | |
| 5,027,687 | 7/1991 | Iwamatsu . | |
| 5,027,689 | 7/1991 | Fujimori . | |
| 5,208,860 | 5/1993 | Lowe et al. | 381/17 |
| 5,212,733 | 5/1993 | DeVitt et al. . | |
| 5,265,516 | 11/1993 | Usa et al. . | |
| 5,291,556 | 3/1994 | Gale . | |
| 5,337,363 | 8/1994 | Platt . | |
| 5,361,333 | 11/1994 | Ahlquist, Jr. et al. . | |

FOREIGN PATENT DOCUMENTS

| | | |
|---|---|---|
| 0516183 A1 | 12/1992 | European Pat. Off. . |
| 2277239 A | 10/1994 | United Kingdom . |
| WO 88/02958 | 4/1988 | WIPO . |
| WO 91/13497 | 9/1991 | WIPO . |

*Primary Examiner*—Forester W. Isen

*Attorney, Agent, or Firm*—Nixon & Vanderhye P.C.

[57] ABSTRACT

An audio signal processing system in which a visual display (15) is arranged to provide a visual representation (16) of a sound generating device (111) a notional listening position and a space in which a perceivable sound source may be located. A visual characteristic of the displayed space is modified so as to represent a characteristic relevant to the sound generating device when a perceivable sound source is located at respective positions within a displayed space

24 Claims, 8 Drawing Sheets

AUDIO SIGNAL PROCESSING

RELATED APPLICATIONS

This application is related to copending commonly assigned U.S. patent application Ser. No. 08/228,365 filed Apr. 5, 1994 naming Messrs. Hill and Willis as inventors.

FIELD OF THE INVENTION

The present invention relates to audio signal processing. In particular, the present invention relates to audio signal processing, wherein a visual display is arranged to provide a visual representation of a sound generating device, a notional listening position and a space within which a perceivable sound source may be located.

BACKGROUND TO THE INVENTION

A system for mixing five channel sound for an audio plane is disclosed in British Patent Publication 2 277 239. The position of a sound source is displayed on a VDU relative to the position of a notional listener. The sound sources are moved within the audio plane by operation of a stylus on a touch tablet, allowing an operator to specify positions of a sound source over time, whereafter a processing unit calculates gain values for the five channels at sample rate. Gain values are calculated for the track for each of the loudspeaker channels and for each of the specified points. Gain values are then produced at sample rate by interpolating calculated gain values for each channel at sample rate.

SUMMARY OF THE INVENTION

According to a first aspect of the present invention, there is provided an audio signal processing apparatus, comprising visual display means arranged to provide a visual representation of a sound generating device, a notional listening position and a space within which a perceivable sound source may be located; and means for modifying a visual characteristic of said displayed space so as to represent a characteristic relevant to said sound generating device when a perceivable sound source is located at said selectable position.

Thus, in addition to being provided with sliders in order to allow adjustment of parameters, an operator may also be provided with a visual representation in which a visual characteristic of a displayed space is modified at selectable positions, so as to represent the relevant sound characteristic at that position.

Preferably, the displayed visual characteristic is responsive to amplification gain, therefore, at each point, the displayed characteristic represents gain levels of signals supplied to sound generating devices, such as loudspeakers.

In a preferred embodiment, the means for modifying the visual characteristic of the displayed space includes means for modifying luminance values for said displayed space. However, in alternative embodiments, other characteristics of the displayed space may be modified, such as colour or saturation etc. Preferably, when luminance is modified, loud positions are shown as bright areas and quiet positions are shown as dark areas.

Preferably, a plurality of sound generating devices are visually represented. Sound generating devices may be represented in any arrangement, mapping on to the arrangement of loudspeakers provided within a theatre or cinema etc. For example, the loudspeakers may be arranged in a pentagon in accordance with digital theatre sound (DTS) recommendations. However, it should be appreciated, that the invention is equally applicable to any other preferred sound format.

According to a second aspect of the present invention, there is provided a method of processing audio signals, comprising steps of providing a visual representation of a sound generating device, a notional listening position and space within which a perceivable sound source may be located; and modifying a visual characteristic of said displayed space so as to represent a characteristic relevant to said sound generating device when a perceivable sound source is located at respective positions in said displayed space.

Preferably, the modification to said characteristic is responsive to amplification gain and said visual characteristic may be the luminance of displayed picture elements.

In a preferred embodiment, the visual display is divided into a plurality of regions and said characteristic is calculated for each of said regions. Said regions may be of constant size however, preferably, said regions are smaller close to the position of the notional listener and increase in size at positions further away from said notional listener.

DETAILED DESCRIPTION OF A PREFERRED EMBODIMENT

Figure 1:
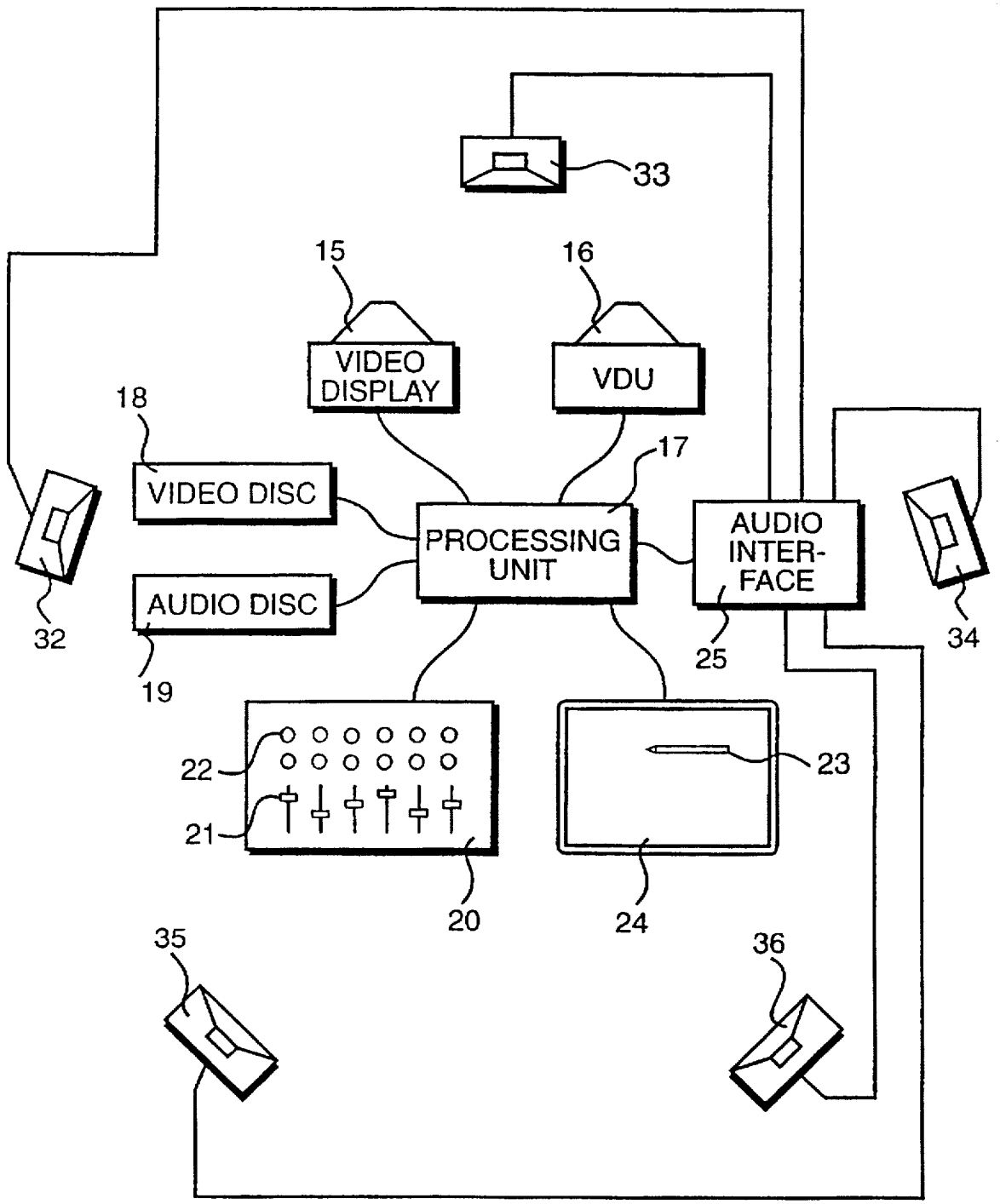
FIG. 1 shows a system for mixing audio signals, including an audio mixing display, input devices and a processing unit.

A system for processing, editing and mixing audio signals and for combining said audio signals with video signals, is shown in FIG. 1. Video images and overlaid video related information are displayable on a video monitor display 15, similar to a television monitor. In addition, a computer type visual display unit 16 is arranged to display information relating to audio signals. Both displays 15 and 16 receive signals from a processing unit 17 which in turn receives compressed video data from a magnetic disc drive 18 and full bandwidth audio signals from an audio disc drive 19.

The audio signals are recorded in accordance with professional broadcast standards at a sampling rate of 48 Khz. Gain control is performed in the digital domain at full sample rate in real-time. Manual control is effected via a control panel 20, having manually operable sliders 21 and tone control knobs 22. Information is also supplied via manual operation of a stylus 23 upon a touch tablet 24. Video data is stored on the video storage disc drive 18 in compressed form and said data is de-compressed in real-time for display on the video display monitor 15 at full video rate. The video information may be encoded as described in the applicants co-pending international Patent application published as WO 93/19467.

In addition to moving the position of the notional sound source with respect to time, it is also possible to adjust other parameters which will influence the overall effect. In particular, the previous system provided means for adjusting sound divergence, that is to say the spread of the sound over a plurality of positions. The previous system also allows a parameter referred to as distance decay to be adjusted, which, as the name suggests, effectively provides a scaling parameter, relating distance travelled over the display screen to perceived distance travelled by the notional sound source.

In the known system, adjustments are made to these parameters by adjusting soft sliders displayed on the VDU. With practice, an operator would become accustomed to these sliders and, for a given situation, would probably be able to make suitable adjustments. However, to a lay-operator, adjusting sliders does not provide a very intuitive interface, therefore a problem with the known system is that operators could experience difficulties in obtaining optimum settings of the available parameters.

The system shown in FIG. 1 provides audio mixing synchronized to video timecode. Original images are recorded on film or on full bandwidth video, with timecode, and are then converted to a compressed video format to facilitate the editing of audio signals against compressed frames having an equivalent timecode. The audio signals are synchronized to the time code during the audio editing process, thereby allowing the newly mixed audio to be accurately synchronized and combined with the original film or full-bandwidth video.

The audio channels are mixed such that a total of six output channels are generated, each stored in digital form on the audio storage disc drive 19. In accordance with convention, the six channels represent a front left channel, a front central channel, a front right channel, a left surround channel, a right surround channel and a boom channel. The boom channel stores low frequency components which, in the auditorium or cinema, are felt as much as they are heard. Thus, the boom channel is not directional and sound sources having direction are defined by the other five full-bandwidth channels.

The apparatus shown in FIG. 1 is arranged to control the notional position and movement of sound sources within a sound plane. The audio mixing display 16 is arranged to generate a display showing the spatial arrangement of sound generating devices such as loudspeakers. In addition to the loudspeakers, the position of a notional listener is represented, along with the position of a notional sound source, created by supplying contributions of an original sound source to a plurality of the loudspeakers.

The audio display 16 also displays menus, from which particular operations may be selected in response to operation of the stylus 23 upon the touch tablet 24. Movement of the stylus 23, while in proximity to the touch tablet 24, results in the generation of a cross-shaped curser upon the VDU 16. Menu selection from the VDU 16 is made by placing the cursor over a menu box and thereafter placing the stylus into pressure. The fact that a particular menu item has been selected is identified to the operator by a change in colour of that item. Thus, for example, from the menu, an operation may be selected such as to allow the positioning of a sound source. Thereafter, as the stylus is moved over the touch tablet 24, the cross represents the position of a selected sound source and once a desired position has been located, the stylus may be placed into pressure again, resulting in a marker remaining in the selected position. Thus, operation of the stylus in this way effectively instructs the system to the effect that, at a specified point in time, relative to the video clip, a particular audio source is to be positioned at the specified point.

In operation, an operator selects a portion of a video clip for which sound is to be mixed. All available input sound data is written to the audio disc storage device 19, at full audio bandwidth, effectively providing randomly accessible sound clips to the operator. Thus, after selecting a particular video clip, the operator may select audio clips to be added to the selected video clip. Once an audio clip has been selected, a fader 21 is used to control the overall loudness of the audio signal and other modifications to tone may be made via means of the tone controls 22.

By operating the stylus 23 upon the touch tablet 24, a menu selection is made to position the selected sound source within the audio plane. Thus, after making this selection, the VDU displays an image allowing the operator to position the sound source within the audio plane. On placing the stylus 23 into pressure, a processing unit 17 is instructed to store that particular position in the audio plane, with reference to the selected sound source and the duration of the selected video clip; whereinafter gain values are generated when the video clip is displayed. Audio tracks are stored as digital samples and the manipulation of the audio data is effected within the digital domain. Consequently, in order to ensure that gain variations are made without introducing undesirable noise, it is necessary to control gain (by direct calculation or by interpolation) for each output channel at sample-rate definition. Furthermore, this control must also be effected for each originating track of audio information which, in the preferred embodiment, consists of thirty eight originating tracks of audio information. For each output signal, derived from each input channel, digital gain control signals must be generated at 48 Khz.

Movement of each sound source, derived from a respective track, is defined with respect to specified points, each of which define the position of the sound to a specified time. Some of these specified points are manually defined by a user and are referred to as "way" points. In addition, intermediate points are also automatically calculated and arranged such that an even period of time elapses between each of said intermediate points.

After points defining trajectory have been specified, gain values are calculated for the sound track for each of said loudspeaker channels and for each of said specified points. Gain values are produced at sample rate for each channel of each track by interpolating the calculated gain values, thereby providing gain values at the required sample rate. A processing unit 17 receives input signals from control devices, such as the control panel 20 and touch tablet 24, and receives stored audio data from the audio disc storage device 19. The processing unit 17 supplies digital audio signals to an audio interface 25, which in turn generates five analog audio output signals to the five respective loudspeakers 32, 33, 34, 35 and 36.

Figure 2:
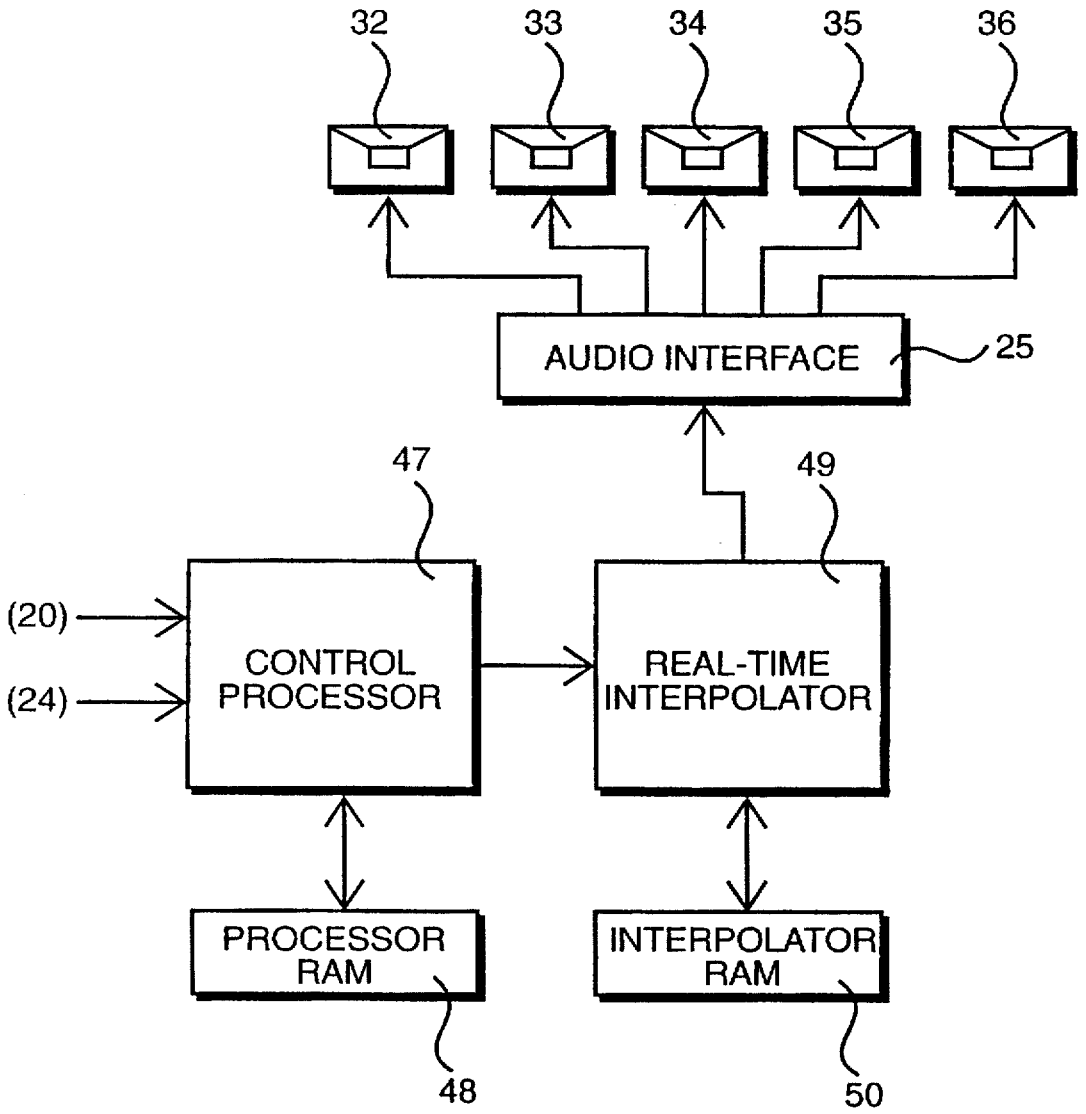
FIG. 2 details the processing unit shown in FIG. 1, including a control processor and a real-time interpolator.

The processing unit 17 is detailed in FIG. 2 and includes a control processor 47 with its associated processor random access memory (RAM) 48, a real-time interpolator 49 and its associated interpolation RAM 50. The control processor 47 is based on a Motorola 68300 thirty-two bit floating point processor or a similar device, such as a Macintosh quadra or an Intel 80486 processor. The control processor 47 is essentially concerned with processing non-real-time information, therefore its speed of operation is not critical to the real-time performance of the system; however it does affect the speed of response to operator instructions.

The control processor 47 oversees the overall operation of the system and the calculation of gain values is one of many tasks. The control processor calculates gain values associated with each specified point, consisting of user defined way points and calculated intermediate points. The trajectory of the sound source is approximated by straight lines connecting the specified points, thereby facilitating linear interpolation performed by the real-time interpolator 49.

Sample points on linearly interpolated lines have gain values which are calculated in response to a straight line equation, $y=mt+c$. During real-time operation, values for t are generated by a clock in real-time and precalculated values for the interpolation equation parameters (m and c) are read from storage. Thus equation parameters are supplied to the real-time interpolator 49 from the control processor 47 and written to the interpolator's RAM 50. Such a transfer of data is effected under the control of the processor 47, which perceives RAM 50 (associated with the real-time interpolator) as part of its own addressable RAM, thereby enabling the control processor to access the interpolator RAM 50 directly. Consequently, the real-time interpolator 49 is a purpose built device having a minimal number of fast real-time components.

The control processor 47 provides an interactive environment under which a user may adjust the trajectory of a sound source and modify other parameters associated with sound sources stored within the system. Thereafter, the control processor 47 is required to effect non-real-time processing of signals in order to update the interpolator's RAM 50 for subsequent use during real-time interpolation.

The control processor 47 presents a menu to an operator, allowing operators to select a particular audio track and to adjust parameters associated with that track. Thereafter, the trajectory of a sound source is defined by the interactive modification of way points.

Figure 3:
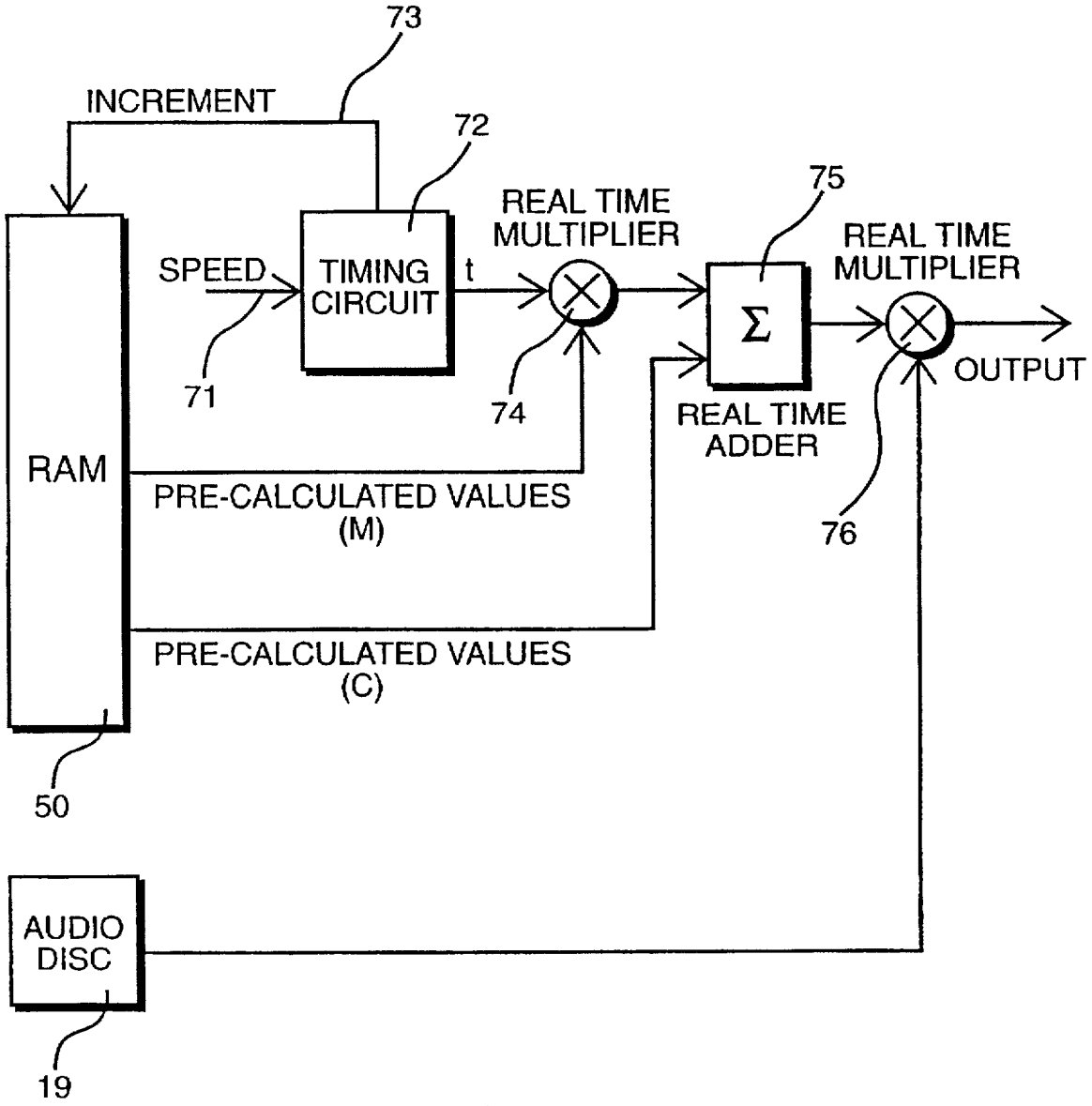
FIG. 3 details operation of the real-time interpolator shown in FIG. 2.

The real-time interpolator 49 is shown in FIG. 3, connected to its associated interpolator RAM 50 and audio disk 19. When the real-time interpolator is activated in order to run a clip, a speed signal is supplied to a speed input 71 of a timing circuit 72. The timing circuit supplies a parameter increment signal to RAM 50 of increment line 73, to ensure that the correct address is supplied to the RAM for addressing the pre-calculated values for m and c. In addition, the timing circuit 72 also generates values of t, from which the interpolated values are derived.

Movement of the sound source is initiated from a particular point, therefore the first gain value is known. In order to calculate the next gain value, a pre-calculated value for m is read from the RAM 50 and supplied to a real-time multiplier 74. The real-time multiplier 74 forms a product of m and t, whereafter said product is supplied to a real-time adder 75. At said real-time adder 75 the output from the multiplier 74 is added to the relevant pre-calculated value for c, resulting in a sum which is supplied to a second real-time multiplier 76. At the second real-time multiplier 76 the product is formed between the output of real-time adder 75 and the associated audio sample, read from the audio disk 19.

Figure 7:
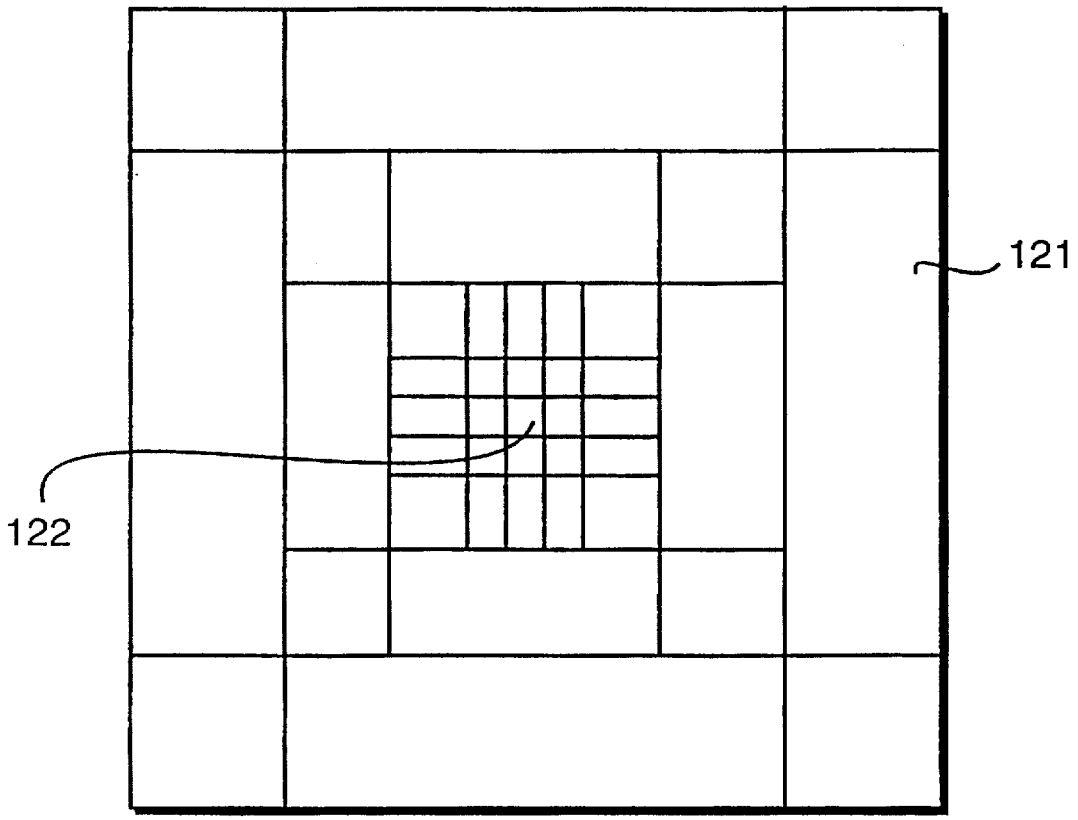
FIG. 7 illustrates how modifiable regions are built up, each consisting of a plurality of pixel locations.

Audio samples are produced at a sample rate of forty-eight kilohertz and it is necessary for the real-time interpolator to generate five channels worth of digital audio signals at this sample rate. In addition, it is necessary for the real-time interpolator to effect this for all of the thirty-eight recorded tracks. In order to achieve this level of calculation, the devices shown in FIG. 7 are consistent with the IEEE 754 thirty-two bit floating point protocol, capable of calculating at an effective rate of twenty million floating point operations per second.

Figure 4:
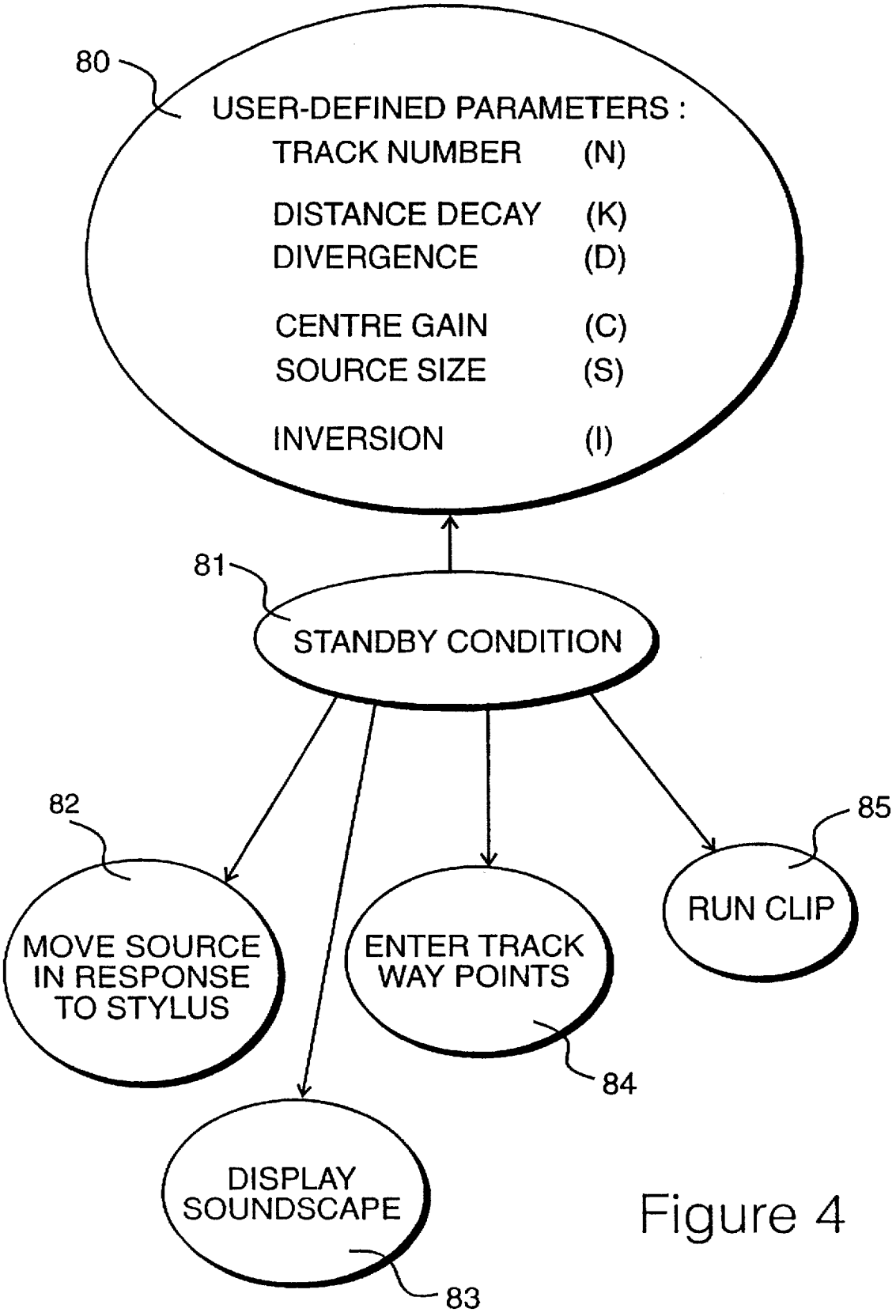
FIG. 4 illustrates modes of operation available to an operator, under the control of the control processor shown in FIG. 2.

Under control of the control processor 47, the system is capable of operating in a plurality of modes, as illustrated in FIG. 4. Thus, from an initial standby condition 81, it is possible for a user to define parameters, as identified by operational condition 82. In addition, it is possible for the stylus 23 to be moved over the touch tablet 24 while listening to a particular input sound source, resulting in the notional sound position being moved interactively in response to movement of the stylus, as indicated by condition 82.

Condition 83 creates a display of what may be referred to as a soundscape. The adjustment of parameters under condition 82 changes the way in which a sound is perceived as it is positioned within the space displayed on the display unit 16. Thus the visual display 16 provides a visual representation of the sound generating loudspeakers, a notional listening position and a space within which the perceived sound source may be located. The processing unit, when operating under condition 83, modifies a visual characteristic of the displayed space at selectable positions so as to represent a characteristic relevant to sound generating devices when the perceived sound source is located at said selectable positions. Thus, when the notional sound source is placed at a particular location, the gain for a particular loudspeaker will be adjusted so as to create the impression that the sound source is perceived as being at that location. Thus, the gain of any particular loudspeaker will vary depending upon the position of the sound source. Furthermore, the actual relationship between position and gain will also depend upon the parameters specified at condition 82, particularly, the parameters specifying distance decay, divergence, centre gain and the source size.

The visual display unit 16 is arranged to visually represent the way in which the gain characteristic varies with respect to selectable positions. In a preferred embodiment, luminance values are modified so as to represent the gain invoked for the selected position. This gain may be displayed with respect to a single loudspeaker or, alternatively, a plurality of loudspeakers, possibly all of the loudspeakers, may be combined so as to give an indication, in terms of displayed luminances, of the gain contributions at any particular selected point. Thus, when all of the loudspeakers have been selected, the luminance at any particular point will represent gain value contributions from all of the available loudspeakers. In this way, an operator is presented with a picture showing the overall nature of the soundscape, thereby allowing interactive modification of the user defined parameters.

After the soundscape has been specified under condition 83, an operator may enter track way points at condition 84, thereby defining the movement of the notional sound source over time, within an identified video clip.

Thereafter, condition 85 may be selected, providing for a selected clip to run. During the running of a clip, interpolated gain values are calculated in real-time, thereby the effect may be presented to an operator in real-time and recorded, if required, in real-time.

When moving the source in response to operation of the stylus, calculating luminance values for the soundscape or running a clip, it is necessary to calculate gain values for each sound generating loudspeaker. In order to achieve this, it is necessary to calculate gain values for loudspeakers as a function of the position of the notional sound source, in addition to user defined parameters.

Figure 5:
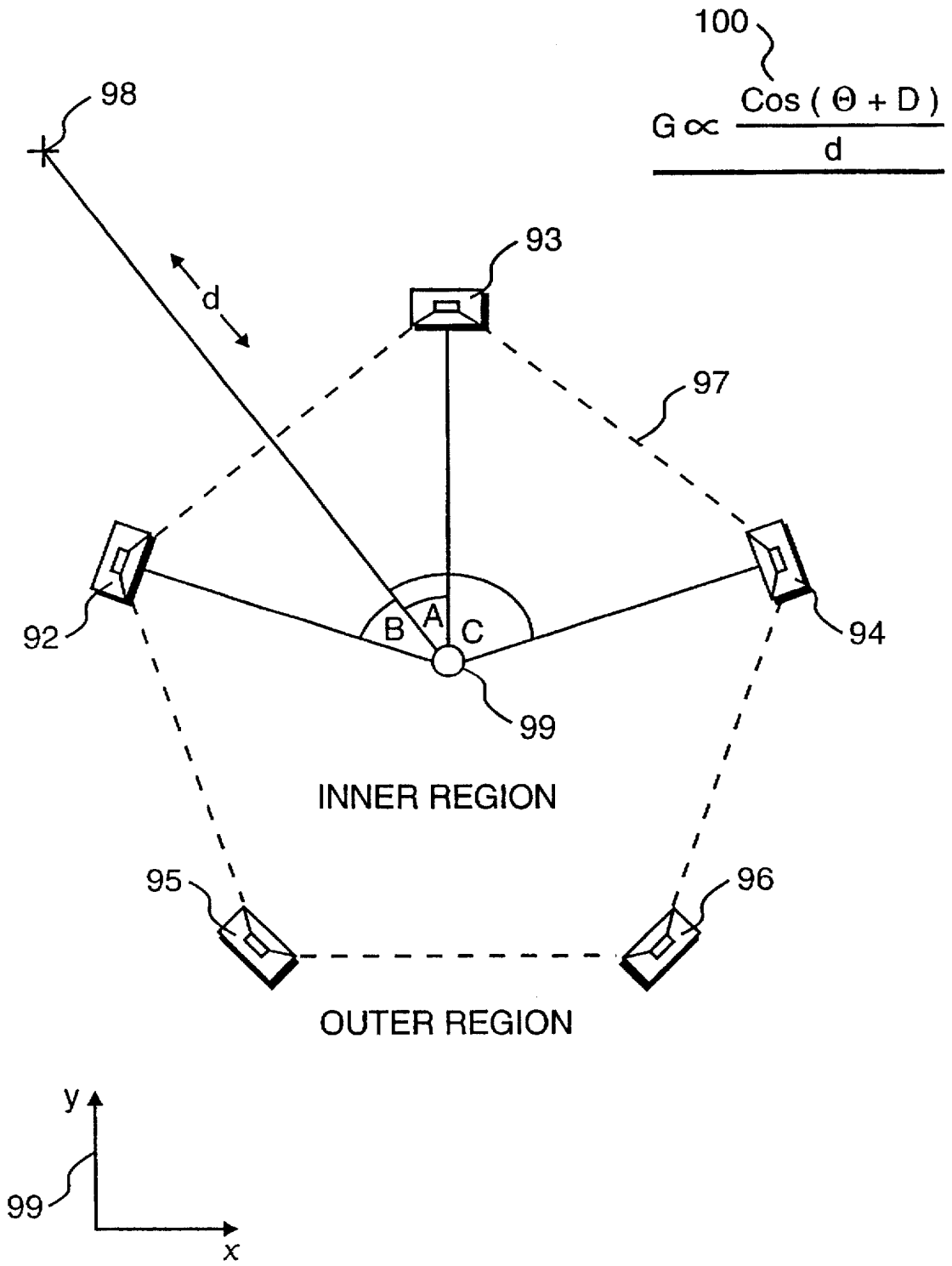
FIG. 5 illustrates a typical display as shown on the visual display unit identified in FIG. 1.

An arrangement of loudspeakers similar to that displayed on the visual display unit 16, is illustrated in FIG. 5. The loudspeaker positions are identified by icons 92, 93, 94, 95 and 96, which map onto physical loudspeakers 32, 33, 34, 35 and 36 of FIG. 1 respectively. A pentagonal outline 97 connects the speakers and effectively provides a boundary between an inner region, bounded by the loudspeaker positions and an outer region, external to said loudspeaker positions.

A notional sound source position is identified by cursor 98. The position of this sound source is selectable by the operator, by operation of the stylus 23 upon the touch tablet 24. Thus, by operation in this way, the cursor 98 has been placed at this position shown in FIG. 5.

Images displayed on the visual display unit 16 are created by reading video information from a frame store at video rate. The frame store is addressed in order to identify locations within it, therefore any position within the frame of reference under consideration has a direct mapping to a location within the frame store. Thus, each position shown within FIG. 5 may be identified with respect to a co-ordinate frame of reference, giving it a Cartesian location specified by x and y coordinates, as represented by the x and y axes 99.

In order for a gain value to be calculated for a particular loudspeaker, it is necessary for reference to be made to a function relating the co-ordinate location of the notional sound source to the position of the notional listener and the position of the loudspeaker. A function of this type is illustrated generally at 100 in FIG. 5. Thus, the gain is given as being proportional to the cosine of the angle between the position of the notional sound source and the position of the loudspeaker under consideration with respect to the position of the notional listener. Thus, when considering loudspeaker 93, the relevant angle is angle A as illustrated in FIG. 5. Similarly, angle B will be relevant for loudspeaker 92 and angle c relevant for loudspeaker 94.

It is possible for an operator to specify a divergence, defining the spread of the source, therefore the divergence value is added to the angle theta and the cosine of this sum is divided by the distance d between the notional listener and the sound source. The position of the sound source is known, in terms of Cartesian coordinates, in addition to the position of the notional listener, in similar coordinates, thereby allowing the distance d to be calculated as a vector between these two points.

Other equations may be implemented for the calculation of gain values and the equation shown in FIG. 5 is merely illustrative.

Figure 6:
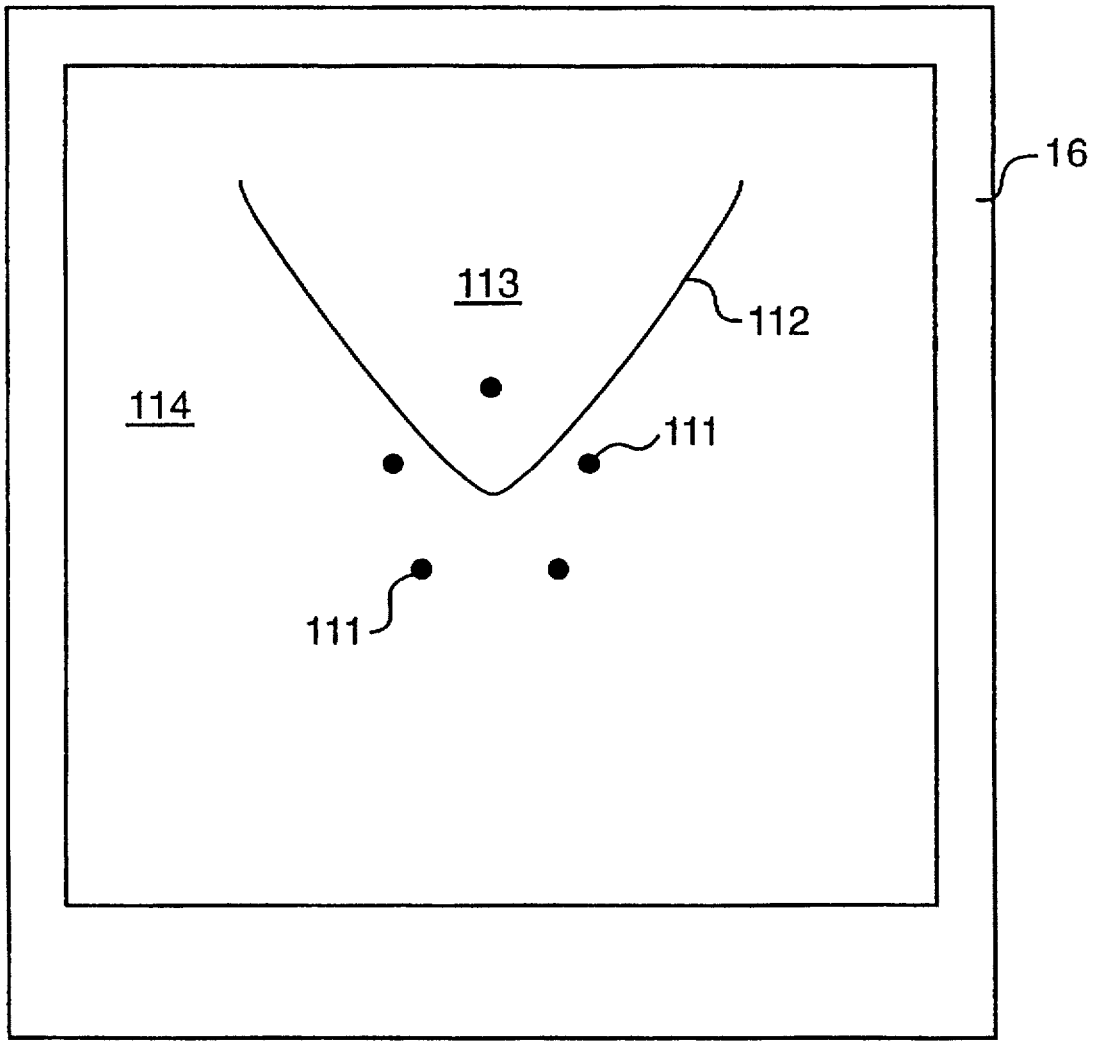
FIG. 6 shows a display for the visual display unit in FIG. 1, generated in response to the soundscape selection illustrated in FIG. 4, in which loudspeaker gains for particular selectable locations are identified by brightness levels at said locations, in which regions of brightness modification vary depending upon the distance from the notional listener.

VDU 16 is shown in FIG. 6, displaying an image of the type provided when the display soundscape condition 83 has been selected. The loudspeaker positions have been identified by dots 111 and an image has been selected which represents a gain distribution relevant to the front central loudspeaker. A gain contour 112 is shown, which may be considered as forming a boundary between an internal region 113 and external regions 114.

When a notional sound source position is located within region 113, positive gain signals will be generated for the front central loudspeaker, resulting in the output from said front central loudspeaker containing a contribution from the sound source under consideration. However, if the notional sound source position is located within region 114, the gain contribution to the front central loudspeaker is zero and the sound is presented to the notional listener as contributions from some or all of the remaining loudspeakers.

Within region 113 the gain generated for the front central loudspeaker does not remain constant and, in order to simulate the position of the notional sound source, a range of gain values will be calculated in accordance with a gain law, such as that suggested by equation 100 in FIG. 5.

The video image displayed on monitor 16, during the soundscape operation, is derived from a full color video frame store such that, under the control of the control processor 47, values may be written to said frame store, resulting in particular output colors being shown on the monitor. Under the "display soundscape" operation, the background color is set to a particular hue, for example, it may be set to a representation of a blue hue, distinctive from other colors used for other modes of operation. Having set the hue it is now possible for the processor 47 to adjust other parameters, such as luminance for particular pixel locations. Thus, within region 113, the luminance of pixel values is mapped onto gain values for the front central loudspeaker. Thus, at particular locations the gain for the loudspeaker will be relatively high, resulting in a relatively high luminance value being written to the corresponding position within the frame store. Similarly, at positions where the calculated gain is relatively low, suitably scaled luminance values are written to the appropriate positions within the frame store. Thus, a soundscape is generated showing how gain values for the loudspeaker under consideration vary, as a graphical representation, with respect to the position of the notional sound source.

In FIG. 6 a representation has been produced for one loudspeaker. However, for any particular setup, it is possible to calculate gain contributions for all of the loudspeakers and to combine the luminance specified gain values concurrently. Thus, a video image is generated showing how gain values, and consequently overall loudness, varies as a notional object is moved within the soundscape. In this way, it is possible for an operator to make modifications to user defined parameters, in response to which variations occur to the displayed soundscape. In this way, parameters may be modified interactively, enabling an operator to define a soundscape for a particular application, without requiring detailed knowledge of the way in which the parameters modify the calculation of gain values.

The calculation of gain values for each pixel position within the frame store (the frame store consisting of, for example, approximately 700×500 pixel locations) would require a significant computational overhead.

There is no reason, in principle, why it would not be possible to calculate gain values for each loudspeaker and for each pixel location. However, in practice, this would require a significant computational overhead which would not be justified by the final outcome.

In order to optimise the calculation of gain values for graphical display, the frame store is divided into a plurality of regions as shown in FIG. 7. The regions are arranged such that they effectively increase in size when moving away from the central location. Close to the position of the notional listener variations tend to occur rapidly as the available loudspeakers exchange responsibility for generating the notional sound source. However, as the notional sound source moves further away from the position of the notional listener, its contributions will tend to be derived from similar loudspeaker sources, therefore the information content diminishes.

As shown in FIG. 7, the notional screen area is divided into a plurality of regions 121 wherein one gain value is calculated per region. Towards the central position of the notional listener, region 122 may comprise a total of four pixel locations. Thus, in this central region, a separate gain value is calculated for each group of four pixel positions. As the selected location moves out from the position of the notional listener, the regions get progressively larger. Thus, towards the periphery of the visual display, regions may comprise one hundred pixel locations in 10×10 blocks.

Referring to FIG. 4, once a soundscape has been displayed in accordance with operation 83, an operator may return to condition 82 and make modifications to define parameters. The soundscape gives the operator an indication as to how the sound will be processed when a particular location has been selected. After obtaining the desired soundscape, the operator may select condition 84, under which way points are entered.

Manual selection via the VDU 16 is made by placing a cross over a menu box and placing the stylus into pressure. The fact that a particular menu item has been selected is identified to the operator via a changing color of that item. Thus, from the menu, an operator may select operation 84 and thereafter position the sound anywhere within the available space for any point in time.

The stylus is moved over the touch tablet 24 resulting in cross 37 representing the position of the selected sound source. Once the desired position has been located, the stylus is placed into pressure and a marker thereafter remains at the selected position. This operation creates data to the effect that at a specified point in time, relative to the video clip, a particular audio source is to be positioned at the specified point. Furthermore, a time code location may be specified by operation of a keyboard or similar device.

Thus, it is necessary for an operator to select a portion of a video clip for which sound is to be mixed. Input sound data is written to the audio disk storage device 19, at full audio bandwidth, thereby making the audio sound track randomly accessible to the operator. After selecting a particular video clip the operator is then in a position to select an audio signal which is to be edited with the selected video. Slider 21 is used to control the overall loudness of the audio signal and modifications to the tone of the signal are made using tone controls 22.

Figure 8:
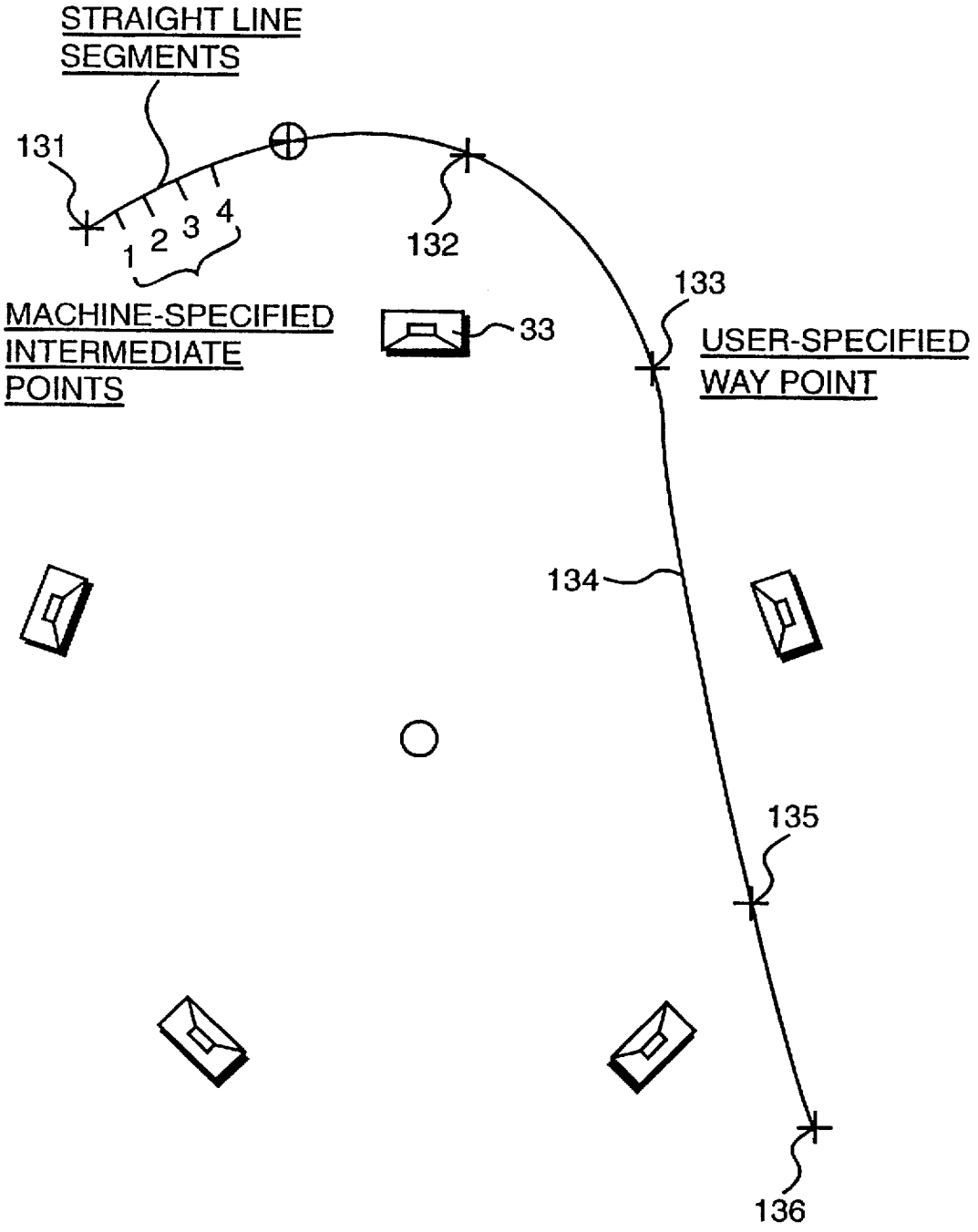
FIG. 8 illustrates the entry of track way points, as identified in FIG. 4, so as to create a sound effect.

As shown in FIG. 8, a user may specify way points 131, 132, 133, 134, 135 and 136. These selected points are connected by a spline defined by additional machine specified intermediate points, identified as 1, 2, 3 and 4 in FIG. 8. During real-time operation, gain values are generated at sample rate by linear interpolation. Thus, line segments between the machine specified points in FIG. 8 are effectively connected by straight lines.

The present invention facilitates the generation of information relating to the movement of sound in three-dimensional space or over a two-dimensional plane. Gain values or other audio-dependent values are calculated at specified locations over a plane and a visual characteristic is modified in order to show variations in these audio characteristics. Thus, in the present embodiment, variations in signal gain are shown as luminance variations although, as it will be appreciated, any audio characteristic which varies with respect to position may be displayed by modifying any visually identifiable characteristic, such as color or saturation etc. as an alternative to luminance.

What we claim is:

1. Audio signal processing apparatus, comprising visual display means arranged to provide a visual representation of a sound generating device, a notional listening position and a space within which a perceivable sound source may be located; and means for modifying a visual characteristic of said displayed space at substantially all locations in said space so as to represent a characteristic relevant to said sound generating device when a perceivable sound source is located at respective positions in said displayed space.

2. Apparatus according to claim 1, wherein said means for modifying a visual characteristic is responsive to the amplification gain used to create the perception of a sound source located at respective positions.

3. Apparatus according to claim 1, wherein said means for modifying said visual characteristic of said displayed space includes means for modifying luminance values for said displayed space.

4. Apparatus according to claim 3, wherein said means for modifying said luminance is arranged such that loud positions are shown as bright areas and quiet positions are shown as dark areas.

5. Apparatus according to claim 1, wherein a plurality of sound generating devices and associated perceivable sound sources are visually represented.

6. Apparatus according to claim 5, wherein said means for modifying a visual characteristic modifies said characteristic in accordance with an expected acoustic response of a selected one of said sound generating devices.

7. Apparatus according to claim 5, wherein said means for modifying said visual characteristic modifies said characteristic in response to an expected combined acoustic response effect of a plurality of the available sound generating devices.

8. Apparatus according to claim 1, including means for defining a track and means for displaying said track on said display means, representing the movement of a notional sound source over time, wherein said visual representation is modified locally as said notional sound source moves through selected regions.

9. Apparatus according to claim 8, including means for effecting movement of the notional sound source in response to manual operation of a selection device.

10. Apparatus according to claim 8, including means for recording a movement track in response to operation of a manual selection device.

11. Apparatus according to claim 1, wherein said displayed space is divided into a plurality of regions and said characteristic is calculated for each of said regions.

12. Apparatus according to claim 11, wherein said regions are smaller close to the position of the notional listener and larger further away from the position of the notional listener.

13. A method of processing audio signals, comprising steps of providing a visual representation of a sound generating device, a notional listening position and a space within which a perceivable sound source may be located; and modifying a visual characteristic of said displayed space at substantially all locations in said space so as to represent a characteristic relevant to said sound generating device when a perceivable sound source is located at respective positions in said displayed space.

14. A method according to claim 13, wherein the modification to said visual characteristic is responsive to the amplification gain used to create the perception of a sound source located at respective positions.

15. A method according to claim 13, wherein the modification of said visual characteristic includes the modification of luminance values for the displayed space.

16. A method according to claim 15, wherein loud positions are shown as bright areas and quiet positions are shown as dark areas.

17. A method according to claim 13, wherein a plurality of sound generating devices and associated perceivable sound sources are visually represented.

18. A method according to claim 17, wherein the visual characteristic is modified in accordance with an expected acoustic response of one of said selected sound generating devices.

19. A method according to claim 17, wherein the visual characteristic is modified in response to an expected combined acoustic response effect of a plurality of the available sound generating devices.

20. A method according to claim 13, including defining a track specifying the movement of a notional sound source and displaying said track, wherein a visual representation is modified locally as said notional sound source moves through selected regions.

21. An audio signal processing apparatus for converting plural input channel audio signals into plural output channel audio signals destined to drive respectively associated acoustic sound generating devices distributed within a space to thereby define a perceivable acoustic sound source, said apparatus comprising:

a visual display depicting a soundscape including a representation of an acoustic field expected to be produced within said space by said sound generating devices, and means for changing said visual display to provide a visualization throughout said depicted space of at least one parameter of the acoustic field expected to emanate from at least one of said sound generating devices.

22. An audio signal processing apparatus as in claim 21 wherein said means for changing controls the luminance of the displayed soundscape at each of plural predetermined displayed areas which correspond to a predetermined expected acoustic parameter at plural corresponding locations within said space.

23. A method for converting plural input channel audio signals into plural output channel audio signals destined to drive respectively associated acoustic sound generating devices distributed within a space to thereby define a perceivable acoustic sound source, said method comprising:

generating a visual display depicting a soundscape including a representation of an acoustic field expected to be produced within said space by said sound generating devices, and changing said visual display to provide a visualization throughout said depicted space of at least one parameter of the acoustic field expected to emanate from at least one of said sound generating devices.

24. A method as in claim 23 wherein said changing step controls the luminance of the displayed soundscape at each of plural predetermined displayed areas which correspond to a predetermined expected acoustic parameter at plural corresponding locations within said space.

* * * * *